US009149106B2

(12) United States Patent
Park

(10) Patent No.: US 9,149,106 B2
(45) Date of Patent: Oct. 6, 2015

(54) METHOD AND APPARATUS FOR ENHANCING UV GEL NAIL APPLICATION

(76) Inventor: Fa Young Park, Leonia, NJ (US)

( * ) Notice: Subject to any disclaimer, the term of this patent is extended or adjusted under 35 U.S.C. 154(b) by 117 days.

(21) Appl. No.: 13/287,880

(22) Filed: Nov. 2, 2011

(65) Prior Publication Data

US 2012/0103354 A1 May 3, 2012

Related U.S. Application Data

(60) Provisional application No. 61/409,331, filed on Nov. 2, 2010.

(51) Int. Cl.
*A45D 31/00* (2006.01)

(52) U.S. Cl.
CPC ..... *A45D 31/00* (2013.01); *A45D 2031/005* (2013.01)

(58) Field of Classification Search
CPC A45D 31/00; A45D 2031/005; A45D 29/001
USPC ..... 132/200, 73, 285
See application file for complete search history.

(56) References Cited

U.S. PATENT DOCUMENTS

| | | | | |
|---|---|---|---|---|
| 1,238,046 | A | | 8/1917 | Hxtrss et al. |
| 2,013,290 | A | | 9/1935 | Rohrbach et al. |
| 2,048,912 | A | | 7/1936 | Ziska et al. |
| 2,162,155 | A | | 6/1939 | Calvin et al. |
| 2,234,657 | A | | 3/1941 | Smaldone et al. |
| 2,239,040 | A | | 4/1941 | Holmes |
| 2,581,982 | A | | 1/1952 | Terry et al. |
| 2,688,331 | A | | 9/1954 | Bogoslowsky et al. |
| 2,746,460 | A | * | 5/1956 | Jellinek ..... 132/73 |
| 2,764,168 | A | | 9/1956 | Herz |
| 2,816,555 | A | | 12/1957 | Klump |
| 3,023,887 | A | | 3/1962 | Cohen |
| 3,603,286 | A | | 9/1971 | Scopp et al. |
| 3,993,084 | A | | 11/1976 | Cullen |
| 4,126,144 | A | | 11/1978 | Duarte |
| 4,158,053 | A | | 6/1979 | Greene et al. |
| 4,169,825 | A | | 10/1979 | Yapp et al. |
| 4,283,324 | A | | 8/1981 | Duffy et al. |

(Continued)

FOREIGN PATENT DOCUMENTS

| | | |
|---|---|---|
| CA | 2461251 | 9/2005 |
| CH | 559019 | 12/1972 |

(Continued)

OTHER PUBLICATIONS

Office Action dated Sep. 2, 2008 in connection with U.S. Appl. No. 11/126,862.

(Continued)

*Primary Examiner* — Todd E Manahan
*Assistant Examiner* — Brianne Kalach
(74) *Attorney, Agent, or Firm* — Carrie Stroup

(57) ABSTRACT

A method of applying a UV gel manicure to a fingernail and a method for achieving a UV gel fingernail extension. First a nail appliqué made of dry nail enamel is applied to a fingernail. A UV gel is then applied with a brush on top of nail appliqué and is cured using a UV lamp. The result is a UV manicure that applied faster than a conventional UV manicure and it is healthier for a nail. UV nail extensions are achieved by applying an appliqué which overhangs from a fingernail and applying and curing UV gel on top of the appliqué.

17 Claims, 3 Drawing Sheets

(56) References Cited

U.S. PATENT DOCUMENTS

| | | | | |
|---|---|---|---|---|
| 4,511,608 | A | 4/1985 | Ferraro | |
| 4,824,702 | A | 4/1989 | Straub | |
| 4,903,840 | A * | 2/1990 | So | 206/581 |
| 4,947,876 | A | 8/1990 | Larsen | |
| 4,954,190 | A | 9/1990 | Taeckens | |
| 5,070,892 | A | 12/1991 | Trematerra | |
| 5,096,750 | A | 3/1992 | Edlert et al. | |
| 5,118,495 | A | 6/1992 | Nafziger et al. | |
| 5,206,011 | A | 4/1993 | Pappas et al. | |
| 5,316,026 | A | 5/1994 | Jenkins | |
| 5,415,903 | A | 5/1995 | Hoffman et al. | |
| 5,525,389 | A | 6/1996 | Hoffmann et al. | |
| 5,782,248 | A | 7/1998 | Chang | |
| 5,866,106 | A | 2/1999 | Papay | |
| 5,908,035 | A | 6/1999 | Carroll et al. | |
| 6,042,679 | A | 3/2000 | Holt et al. | |
| D445,543 | S | 7/2001 | Amen-Ra A | |
| 6,296,836 | B1 | 10/2001 | Engler | |
| 6,303,140 | B1 | 10/2001 | Dever et al. | |
| 6,352,687 | B1 | 3/2002 | Ismailer et al. | |
| 6,354,304 | B1 | 3/2002 | Chang | |
| D459,547 | S | 6/2002 | Wada et al. | |
| 6,472,039 | B1 | 10/2002 | Amen-Ra A | |
| 6,481,444 | B1 * | 11/2002 | Lilley | 132/200 |
| 6,565,835 | B1 | 5/2003 | Socci et al. | |
| 6,626,183 | B1 | 9/2003 | Pietrocola et al. | |
| 6,797,261 | B1 * | 9/2004 | Le | 424/61 |
| 7,143,770 | B1 | 12/2006 | Keller | |
| 8,061,363 | B2 | 11/2011 | Park | |
| 8,061,364 | B2 | 11/2011 | Park | |
| 8,092,786 | B2 | 1/2012 | Park | |
| 2002/0106493 | A1 | 8/2002 | Komuta et al. | |
| 2002/0197435 | A1 | 12/2002 | Ra A | |
| 2003/0175225 | A1 | 9/2003 | Leacock et al. | |
| 2003/0198611 | A1 | 10/2003 | Glassman et al. | |
| 2003/0217758 | A1 | 11/2003 | Mesirow | |
| 2004/0079381 | A1 | 4/2004 | Han | |
| 2005/0061342 | A1 | 3/2005 | Chapman | |
| 2005/0121048 | A1 * | 6/2005 | Han | 132/73 |
| 2005/0150508 | A1 | 7/2005 | Downs et al. | |
| 2005/0199253 | A1 | 9/2005 | Fiore et al. | |
| 2005/0255061 | A1 | 11/2005 | Park | |
| 2007/0025936 | A1 | 2/2007 | Park | |
| 2008/0087291 | A1 * | 4/2008 | Jordan | 132/200 |
| 2008/0236603 | A1 | 10/2008 | Park | |
| 2008/0276951 | A1 | 11/2008 | Park | |
| 2008/0283073 | A1 | 11/2008 | Park | |
| 2009/0233031 | A1 * | 9/2009 | Weber et al. | 428/41.6 |
| 2010/0047301 | A1 | 2/2010 | Park | |
| 2010/0212681 | A1 | 8/2010 | Park | |
| 2011/0117174 | A1 | 5/2011 | Kergosien et al. | |
| 2012/0103354 | A1 | 5/2012 | Park | |
| 2013/0139839 | A1 | 6/2013 | Chang | |
| 2013/0206157 | A1 | 8/2013 | Park | |
| 2013/0220355 | A1 | 8/2013 | Park | |

FOREIGN PATENT DOCUMENTS

| | | | |
|---|---|---|---|
| FR | 1186543 | | 8/1959 |
| JP | 2001353022 | | 12/2001 |
| JP | 3243694 | | 1/2002 |
| JP | 200285148 | | 3/2002 |
| WO | 8802226 | | 4/1988 |
| WO | 8802227 | | 4/1988 |
| WO | 2005112873 | | 12/2005 |
| WO | 2008045282 | | 4/2008 |
| WO | WO 2010020873 | * | 2/2010 |
| WO | 2011141878 | A1 | 11/2011 |
| WO | 2012021244 | A1 | 2/2012 |
| WO | 2012061519 | | 5/2012 |
| WO | 2013155094 | A1 | 10/2013 |

OTHER PUBLICATIONS

Office Action dated Oct. 6, 2009 in connection with U.S. Appl. No. 11/126,862.
Office Action dated Jun. 23, 2010 in connection with U.S. Appl. No. 11/126,862.
Office Action dated Jan. 21, 2011 in connection with U.S. Appl. No. 11/126,862.
Office Action dated Nov. 18, 2009 in connection with U.S. Appl. No. 11/866,678.
Office Action dated May 27, 2010 in connection with U.S. Appl. No. 11/866,678.
Office Action dated Dec. 22, 2010 in connection with U.S. Appl. No. 11/866,678.
Office Action dated Oct. 4, 2011 in connection with U.S. Appl. No. 11/866,678.
Office Action dated Sep. 5, 2012 in connection with U.S. Appl. No. 11/866,678.
Office Action dated Apr. 16, 2013 in connection with U.S. Appl. No. 11/866,678.
Office Action dated Jul. 9, 2013 in connection with U.S. Appl. No. 11/866,678.
Office Action dated Jan. 7, 2009 in connection with U.S. Appl. No. 11/543,481.
Office Acton dated Sep. 14, 2009 in connection with U.S. Appl. No. 11/543,481.
Office Action dated Apr. 2, 2010 in connection with U.S. Appl. No. 11/543,481.
Office Action dated Feb. 14, 2011 in connection with U.S. Appl. No. 12/138,701.
Office Action dated Feb. 14, 2011 in connection with U.S. Appl. No. 12/183,385.
Office Action dated Jul. 26, 2011 in connection with U.S. Appl. No. 12/615,410.
Office Action dated Mar. 6, 2012 in connection with U.S. Appl. No. 12/615,410.
Office Action dated Aug. 23, 2012 in connection with U.S. Appl. No. 12/615,410.
Office Action dated Jun. 7, 2013 in connection with U.S. Appl. No. 12/615,410.
Office Action dated Sep. 12, 2011 in connection with U.S. Appl. No. 12/773,135.
Office Action dated Apr. 18, 2013 in connection with U.S. Appl. No. 12/773,135.
Office Action dated Sep. 26, 2012 in connection with U.S. Appl. No. 12/773,135.
Office Action dated Mar. 30, 2010 in connection with Australian Patent Application No. 2005244843.
Office Action dated Sep. 9, 2011 in connection with Australian Patent Application No. 2005244843.
Office Action dated Jan. 25, 2010 in connection with Canadian Patent Application No. 2,566,113.
Office Action dated Jan. 26, 2011 in connection with Canadian Patent Application No. 2,566,113.
Office Action dated Mar. 6, 2012 in connection with Canadian Patent Application No. 2,566,113.
Office Action dated Apr. 9, 2013 in connection with Canadian Patent Application No. 2,566,113.
Office Action dated Dec. 18, 2012 in connection with Japanese Patent Application No. 2009-531450.
Office Action dated Dec. 28, 2011 in connection with Korean Application No. 10-2006-7026131.
Office Action dated Sep. 28, 2012 in connection with Korean Application No. 10-2006-7026131.
Office Action dated Jun. 3, 2013 in connection with Korean Application No. 10-2013-7002868.
Office Action dated Jul. 14, 2008 in connection with Russian Application No. 2006138905/15.
Office Action dated Feb. 24, 2011 in connection with Russian Application No. 2010107190/12.
International Search Report and Written Opinion dated May 4, 2006 for International Patent Application No. PCT/US2005/016667.

(56) References Cited

OTHER PUBLICATIONS

International Search Report and Written Opinion dated Jun. 16, 2008 for International Patent Application No. PCT/US2007/021305.
International Search Report and Written Opinion dated Mar. 16, 2013 for International Patent Application No. PCT/US2011/059000.
International Search Report and Written Opinion dated Jul. 31, 2013 for International Patent Application No. PCT/US2013/35817.
All About Coconut Oil and Nail Fungus. http://nailfungustreatmentguide.org/coconut-oil-nail-fungus/ (Aug. 11, 2011).

* cited by examiner

METHOD AND APPARATUS FOR ENHANCING UV GEL NAIL APPLICATION

RELATED APPLICATIONS

This Application claims the benefit of U.S. Provisional Pat. Appl. Ser. No. 61/409,331, filed on Nov. 2, 2010, the contents of which are incorporated by reference herein.

FIELD OF THE INVENTION

The current invention relates to the field of nail adornments, more specifically to a novel method of applying UV gel to fingernails.

BACKGROUND OF THE INVENTION

The application of UV gel to fingernails is an increasingly popular method of decorating fingernails in place of ordinary nail enamel. In this process, a salon technician spreads a layer of UV gel on a fingernail and then sets the finger under a UV light which cures the gel. Normally, several gel layers are required. For example, a base coat of UV gel is followed by a pigment-containing UV gel coat and then one or more sealing UV gel coats are applied thereafter. Each of individual layers must be individually brushed on a by a technician and then fully cured under a UV light before an additional coat can be applied. This makes the process extremely time-consuming and burdensome. The skilled technician time that is required in addition to the cost of the materials makes the process very expensive. In fact, a typical UV gel application could take well over an hour and sometime more to apply. If a nail extension is required, the process requires even more labor and skill—thereby increasing the time and cost thereof.

In addition to the time and expense associated with UV applications, there are potential health risks as well. The application requires repeated exposure to UV waves and the gel when cured in contact with a fingernail may damage and weaken the nail. Furthermore, once the UV gel is cured on a fingernail—it is very difficult to remove.

Typically, the layers must be filed off or left to grow out with the natural nail as conventional nail polish removers do not work.

SUMMARY OF THE INVENTION

The current invention is directed to a novel system and method for applying UV gel to fingernails, which significantly reduces the application time and drastically reduces a wearer's UV exposure. Moreover, the UV gel does not directly contact the wearer's fingernail.

In the inventive method, a dry nail enamel appliqué is first applied to a wearer's fingernail—which serves as a base coat. Thereafter, a layer of UV gel is applied on top of the appliqué and is cured under a UV light. The appliqué comprises nail enamel in a semi-cured form and an adhesive backing for affixing the same to a nail. The nail appliqué provides a smooth layer of colored nail enamel and the layer of cured UV gel applied atop thereof, provides the cross-linking and the smooth "glassy" finish associated with UV gel application.

Not only do embodiments of the invention achieve a beautiful UV gel manicure—with significantly less time and UV exposure—but because a nail appliqué is in direct contact with the wearer's nail, the UV gel does not directly contact the wearer's fingernail. Instead, the UV gel cures on top of the nail appliqué. This is not only much healthier for the nail, but it also allows for more efficient removal of the gel using conventional nail polish remover.

In addition, nail extensions are efficiently achieved in accordance with the invention. In an embodiment of the invention, a sufficiently rigid dry nail appliqué is applied to a fingernail in a manner such that a portion of the appliqué extends past the edge of the fingertip. With the appliqué so positioned, UV gel is then applied atop thereof and cured. After the UV gel is cured, there is a hardened nail enamel/UV gel surface extending past the wearer's fingertip (the extension portion). The extension portion could be trimmed and shaped using a nail clipper or another shearing device.

U.S. Patent Appl. Pub. No. 2009/0233031 discloses a nail appliqué that has an enamel layer and a pre-cured UV layer applied atop of the enamel layer. However, the current invention allows for a more durable application, is customizable to a user and allows for nail extensions as described below.

DETAILED DESCRIPTION OF THE INVENTION

Figure 1:
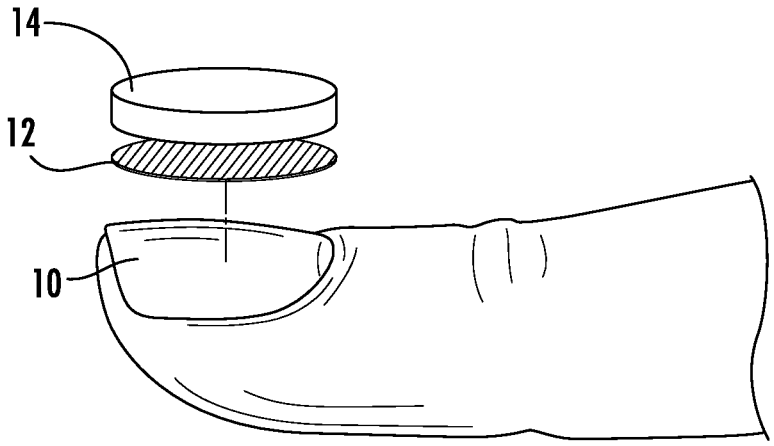
FIG. 1 is a side, schematic representation of a nail enamel appliqué and a UV gel layer atop of a fingernail according to an embodiment of the invention.

The following is a detailed description of the preferred embodiments of the invention, reference being made to the drawings in which the same reference numerals identify the same elements of structure in each of the several figures. It should be noted that these drawings are merely exemplary in nature and in no way serve to limit the scope of the invention, which is defined by the claims appearing herein below.

As mentioned, the current state of applying UV gel requires, at a minimum, three gel layers. Each layer requires careful application of the gel and curing time under a UV light. In the present invention only one layer of UV gel is required to achieve a similar effect.

As shown schematically in FIG. 1, a bottom layer comprising a dry nail appliqué12 is first affixed to a fingernail 10.

The nail appliqué provides nail polish of a desired color, but it additionally prepares the nail for receiving UV gel by providing a smooth finish on the nail. The nail appliqué is in direct contact with the nail—serving as a buffer between the nail top and the overlaying UV gel.

Once the appliqué is firmly applied to the fingernail, a layer of UV gel 14 is brushed to the top surface thereof and cured under a UV light for about 2 minutes—or for as long as necessary to achieve satisfactory curing. Once so cured, the UV and nail enamel fuse together to form a beautiful UV gel nail manicure. It will be understood by those of ordinary skill in the art that any cross-linkable polymer may be applied atop of a nail appliqué. In addition, curing of such cross-linkable polymers may be achieved by way of a UV lamp or any similar suitable source of thermal energy.

The nail appliqué used as the bottom layer is preferably a nail appliqué made from real nail enamel cut into a substantially fingernail shaped section. The nail appliquéhas an adhesive bottom surface, which adheres the bottom surface of the nail appliqué to the top surface of a fingernail. After applying the nail appliqué to the fingernail—any excess portion of the appliqué is sheared off using a fingernail or a shearing device.

An important aspect of the nail appliqué is that when it is manufactured it is not allowed to fully dry before being sealed within a plastic package. Therefore, after it is applied to a user's fingernail, the final curing step takes place on the fingernail. As such, the nail appliqué behaves much like traditional, brush-on nail polish—only it is applied in dry form. In embodiments of the invention, the nail appliqué is preferably one similar to the appliqué described in U.S. patent application Ser. No. 11/126,862 or U.S. Pat. No. 4,903,840 and incorporated by reference herein and may include a plurality of partially cured nail enamel layers atop an adhesive layer.

Conventional nail polish has the advantage of being applied rather quickly, does not require UV exposure and does not pose a health risk to a fingernail. On the other hand, a UV gel manicure has a more appealing look than a traditional manicure and it is much more durable. The instant invention, essentially, achieves the best of both worlds in that a beautiful, durable UV gel manicure is achieved in reduced application time and with minimal UV exposure. Moreover, the UV gel does not directly contact an underlying fingernail.

Furthermore, embodiments of the invention allow for similar rapid and efficient applications of fingernail extensions. In the current state of the art, applying a fingernail extension using UV technology is an extremely arduous process requiring significant time, materials and expertise. To achieve a nail extension, a slender strip of material is inserted in the underside of a nail to act as a substrate to receive UV gel. Once the UV gel is applied and cured, the layer often requires grinding or other adjustments to ensure a smooth transition between the natural nail and the extended portion. An extension, as such, requires several coats, high UV exposure requires a significant amount of time and skill and it is very expensive. As an alternative to UV gel extensions, users often glue plastic nails to their fingers. The rigid plastic does not easily conform to the natural shape of a fingernail. In addition, it must be glued to the fingernail—which is unhealthy and difficult to remove.

Figure 2:
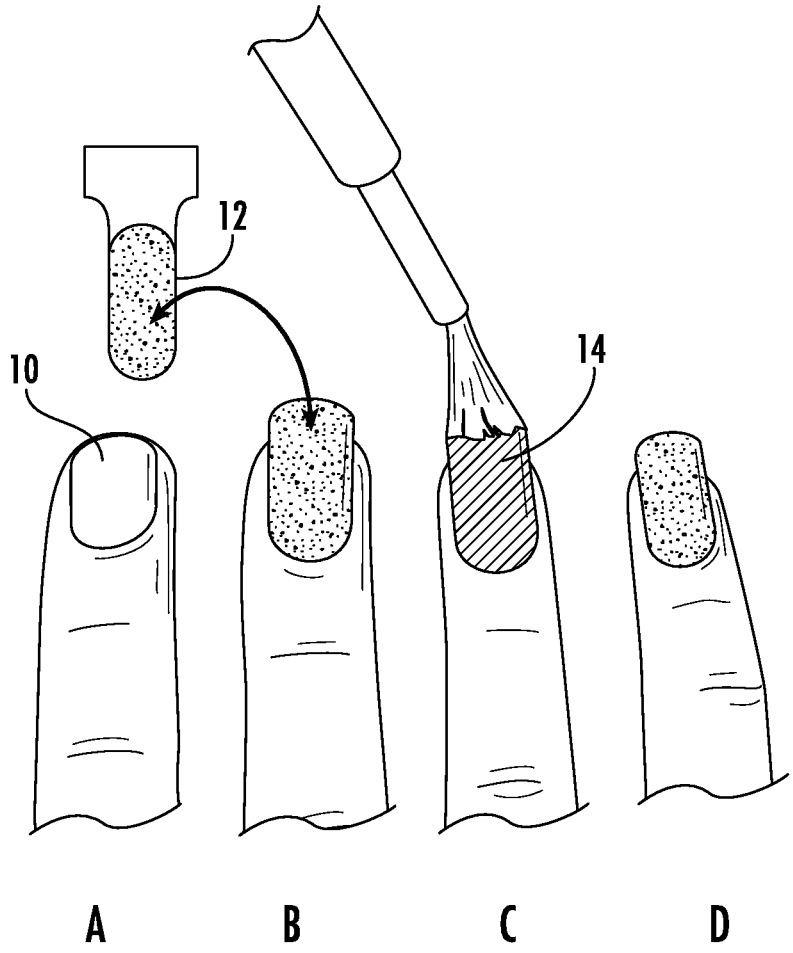
FIG. 2 shows several top views of a fingernail showing various steps associated with applying a nail extension according to an embodiment of the invention.

In an embodiment of the invention, a nail extension is achieved rapidly, efficiently and with minimal UV exposure. FIG. 2 shows the process of applying an extension according to an embodiment of the invention. Beginning with an unadorned fingernail (step A), a wearer or technician applies a nail enamel appliqué 12 to the fingernail—leaving a portion of the appliqué overhanging the edge of the nail tip (step B). The length of the appliqué overhang may range from several centimeters to ¾ of an inch—or even more. The appliqué is pressed on to the nail until it is securely affixed thereto. The nail appliqué 12 is of sufficient rigidity such that it remains extended past the nail tip—substantially in the same plane as the fingernail (as shown in step B). Thereafter, UV gel 14 is applied to the entire top surface of the nail appliqué (step C). The nail, which now has an appliqué 12 covering and extending from it and a layer of UV gel 14 supported thereon (as shown, schematically in FIG. 4), is then inserted beneath a UV light and cured. After sufficiently curing to achieve a "glassy" finish, the extended portion of the nail appliqué (and UV layer) is preferably cut to a desired length and shape by way of a nail clipper or such similar shearing device (step D). The UV gel is transparent or translucent when cured, such that the underlying nail appliqué is visible through the cured UV gel layer (as shown in Step D). This gives a technician or wearer the freedom to select any of various appliqué styles or designs to be used in combination with a top UV gel layer.

Figure 3:
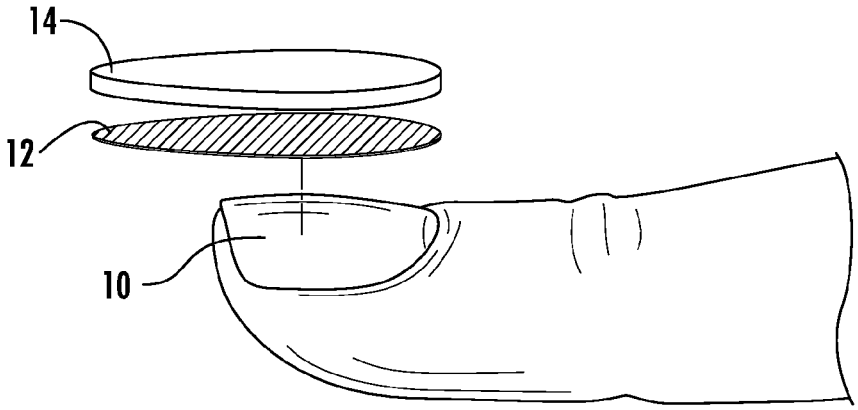
FIG. 3 is a side, schematic representation of a fingernail extension according to an embodiment of the invention.

FIG. 3 shows a schematic view of the nail tip extension described above. As shown, a dry enamel nail appliqué 12 is applied to the fingernail such that it extends past the tip thereof. A layer of UV gel 14 rests on the appliqué. When the UV gel 14 is cured it becomes affixed to the appliqué 12 upon which it is applied.

Figure 4:
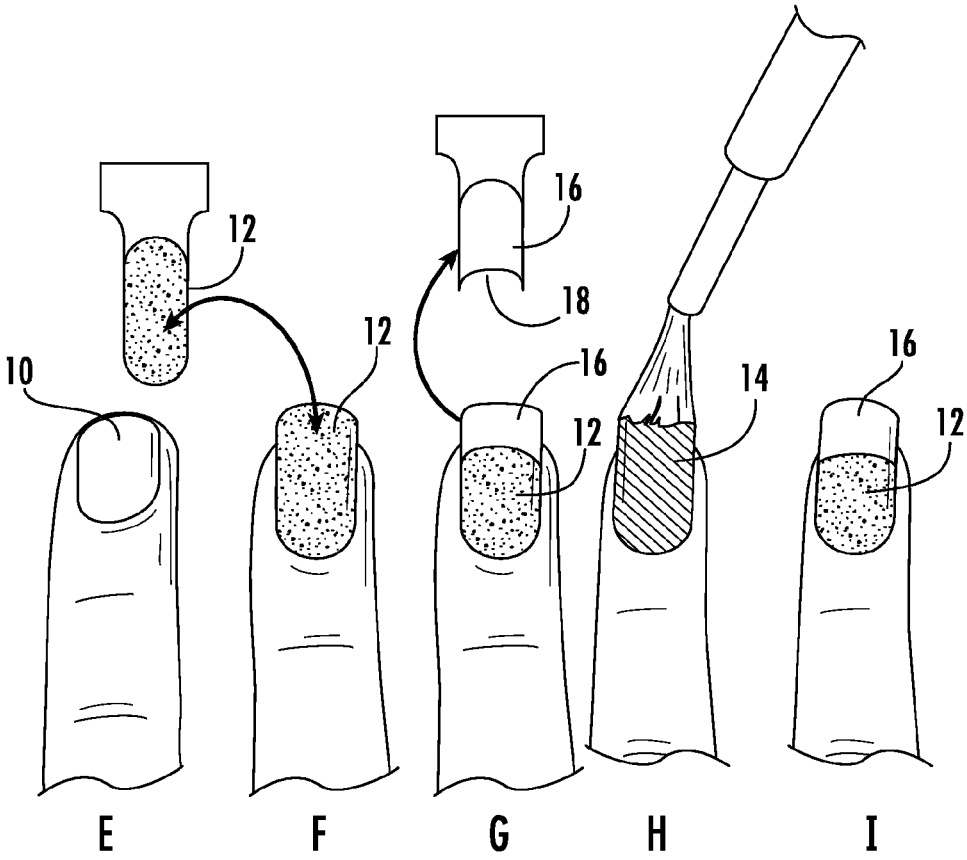
FIG. 4 shows several top views of a fingernail showing various steps associated with applying a French nail extension according to an embodiment of the invention.

In another embodiment of the invention, a French-style nail extension is achieved. As shown in FIG. 4, beginning with an unadorned fingernail (step E), a nail enamel appliqué 12 of a first color (e.g. pink) is applied to the entire fingernail and securely affixed thereto (step F). Next, a second tip appliqué 16 of a second color (e.g. white) is applied to the nail tip (step G). The tip appliqué 16 comprises a rounded or curved edge 18, which roughly follows the contours of a nail tip when applied thereto. Tip appliqué16 is of sufficient rigidity such that when it is applied to a fingertip and so anchored thereto—its remaining length will remain overhanging the nail tip in substantially the same plane as the nail's top surface (as shown in step G). Thereafter, UV gel is brushed onto the top surface of the nail appliqué 12 and nail tip appliqué 16 covering, both, the nail appliqué 12 and the overhanging tip appliqué 16 (step H). The nail is then inserted beneath a UV light and cured. After sufficiently curing to achieve a "glassy" finish, the extended portion of the nail appliqué (and UV layer) is preferably cut to a desired length and shape by way of a nail clipper or such similar shearing device (step 1). As described above, the transparent or translucent cured UV layer allows the underlying appliqués to be viewed. in that manner, a nail having a first color (e.g. pink) and an extending tip having a second color (e.g. white) is achievable to yield a French manicure.

Figure 5:
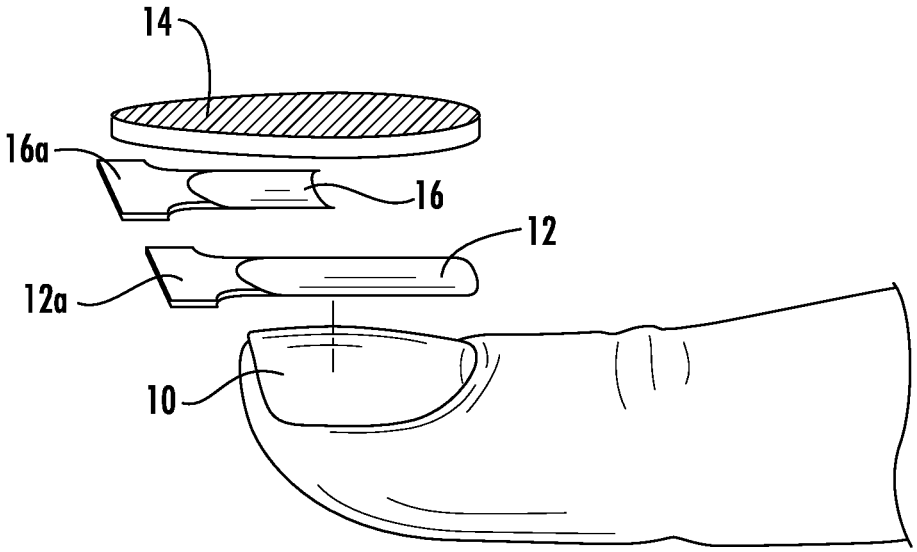
FIG. 5 is a side, schematic representation of the nail application of FIG. 4.

FIG. 5 shows a schematic view of the French tip extension described above. A bottom appliqué 12 is shown which substantially covers an entire fingernail. A second nail tip appliqué 16 is applied to the nail tip and extends therefrom. Finally, a UV gel layer 14 is applied atop the nail appliqué 12 and the nail tip appliqué 16. Note that portions 12*a* and 16*a* of nail appliqué 12 and nail tip appliqué 16 are handling tabs, which are separated from the main body of the appliqués—preferably by way of a partial cut or perforation.

Figure 6:
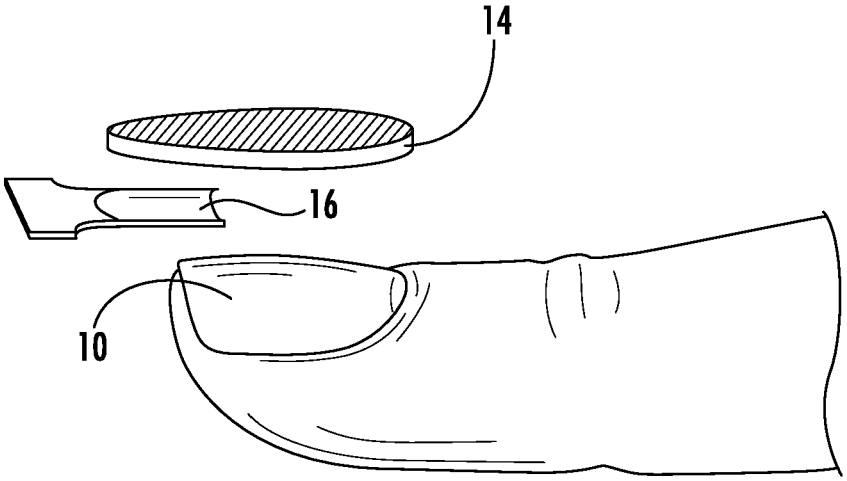
FIG. 6 is a side, schematic representation of a nail tip appliqué extending from a fingernail and a UV gel layer applied atop thereto according to an embodiment of the invention.

FIG. 6 shows a schematic view of another embodiment of the invention, whereby a nail tip appliqué 16 is applied directly to a fingernail 10 and which extends therefrom. A UV layer 14 is applied atop the natural nail and the nail appliqué.

It will be understood by those of ordinary skill in the art that any of various top coats may be applied atop the UV layer described above. A top coat may comprise a clear and or translucent UV or enamel coat or such combination thereof Having described this invention with regard to specific embodiments, it is to be understood that the description is not meant as a limitation since further modifications and variations may be apparent or may suggest themselves to those skilled in the art. It is intended that the present application cover all such modifications and variation as fall within the scope of the appended claims.

What is claimed is:

1. A method of adorning and un-adorning a nail, comprising the steps of:

adorning a nail by, applying a nail appliqué directly atop the nail , said nail appliqué comprising partially dried colored nail enamel and an underlying adhesive layer;

allowing said nail enamel to fully dry after the application of said appliqué to the nail;

removing an excess portion of said nail appliqué;

applying UV gel directly atop said dry nail appliqué after the performance of said step of applying the nail appliqué to the nail, said nail appliqué forming a buffer between the nail and said UV gel such that said UV gel is inhibited from coming into contact with the nail; and curing said UV gel with a UV light so as to form a cured UV gel layer on said nail appliqué, said cured UV gel layer being transparent or translucent;

wherein said nail appliqué is rigid and dry, and said nail appliqué extends past a tip of the nail in substantially the same plane as the nail, and subsequently un-adorning the nail by removing said UV gel layer and nail appliqué from said nail with the use of a conventional nail polish remover.

2. The method of claim 1, further comprising the step of shaping said cured UV gel layer and nail appliqué with a shearing device.

3. The method of claim 1, wherein said UV gel is applied atop of substantially the entire surface of said nail appliqué applied to the nail and extending therefrom.

4. The method of claim 3, further comprising the step of shaping a tip of said nail appliqué and said cured UV gel layer with a shearing device.

5. The method of claim 1, wherein said nail appliqué includes at least one nail enamel layer positioned on said adhesive layer, said at least one nail enamel layer being formed of said partially dried nail enamel.

6. The method claim 5, wherein said at least one nail enamel layer has a pair of opposing axial ends and a smooth upper surface extending continuously from one of said opposing axial ends to the other of said opposing axial ends.

7. The method claim 6, wherein said upper surface of said at least one nail enamel layer is exposed in its entirety at least prior to the performance of said step of applying said UV gel on said nail appliqué.

8. The method claim 5, wherein said at least one nail enamel layer includes a plurality of layers of partially dried nail enamel.

9. The method claim 1, wherein said UV gel is directly applied atop of substantially the entire surface of said nail appliqué.

10. The method claim 1, wherein said excess portion of said nail appliqué extends beyond an edge of the nail, said excess portion being removed with the use of a shearing device during the performance of said removing step.

11. A method of adorning and un-adorning a nail, comprising the steps of:

adorning a nail by, applying a nail appliqué directly atop the nail, said nail appliqué comprising partially dried nail enamel and wherein said nail appliqué includes an underlying adhesive layer;

applying a nail tip appliqué to the nail appliqué ,said nail tip appliqué comprising a curved edge, said curved edge being shaped to substantially conform to a tip of the nail, said curved edge being applied to the a tip of the nail and a remainder of said nail tip appliqué extending past said tip of said fingernail;

allowing said nail enamel of said nail appliqué to fully dry after the application of said appliqué to the nail;

applying UV gel directly atop of said nail appliqué after the performance of said step of applying the nail appliqué to the nail, said nail appliqué forming a buffer between the nail and said UV gel such that said UV gel is inhibited from coming in contact with the nail;

curing said UV gel with a UV light so as to form a cured UV gel layer on said nail appliqué , said cured UV gel layer being transparent or translucent;

and wherein said nail appliqué is rigid and dry, and said nail appliqué extends past a tip of the nail in substantially the same plane as the nail, and subsequently un-adorning the nail be removing said UV gel layer and nail appliqué using conventional nail polish remover.

12. The method of claim 11, wherein said nail appliqué has a first color and said nail tip appliqué has a second color.

13. The method of claim 11, wherein said nail tip appliqué includes partially cured nail enamel.

14. The method of claim 11, further comprising the step of shaping a tip of said appliqué and said cured UV layer with a shearing device.

15. The method claim 11, wherein said nail appliqué includes at least one nail enamel layer positioned on said adhesive layer, said at least one nail enamel layer being formed of said partially dried nail enamel.

16. The method claim 15, wherein said at least one nail enamel layer has a pair of opposing axial ends and a smooth upper surface extending continuously from one of said opposing axial ends to the other of said opposing axial ends.

17. The method claim 16, wherein said upper surface of said at least one nail enamel layer is exposed in its entirety at least prior to the performance of said step of applying said nail appliqué to the nail.

* * * * *